US009256171B2

(12) United States Patent
Moon et al.

(10) Patent No.: US 9,256,171 B2
(45) Date of Patent: Feb. 9, 2016

(54) FUSING DEVICE INCLUDING A GUIDE MEMBER TO GUIDE A PRINTING MEDIUM AND IMAGE FORMING APPARATUS HAVING THE SAME

(71) Applicant: SAMSUNG ELECTRONICS CO., LTD., Suwon-si, Gyeonggi-do (KR)

(72) Inventors: Sang Cheol Moon, Gunpo-si (KR); Dae Won Kang, Goyang-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 26 days.

(21) Appl. No.: 13/919,281

(22) Filed: Jun. 17, 2013

(65) Prior Publication Data

US 2014/0233991 A1 Aug. 21, 2014

(30) Foreign Application Priority Data

Feb. 15, 2013 (KR) ..... 10-2013-0016268

(51) Int. Cl.
*G03G 15/20* (2006.01)
*G03G 15/00* (2006.01)

(52) U.S. Cl.
CPC ..... *G03G 15/2028* (2013.01); *G03G 15/657* (2013.01); *G03G 2215/00413* (2013.01)

(58) Field of Classification Search
CPC ..... G03G 15/2085; G03G 15/657; G03G 2215/00413
USPC ..... 399/322, 400
See application file for complete search history.

(56) References Cited

U.S. PATENT DOCUMENTS

| | | | | |
|---|---|---|---|---|
| 2002/0131801 | A1* | 9/2002 | Tomatsu | 399/400 |
| 2004/0146323 | A1* | 7/2004 | Fujisawa et al. | |
| 2004/0234305 | A1* | 11/2004 | Nakano et al. | 399/322 |
| 2007/0196135 | A1* | 8/2007 | Fukuta | |
| 2008/0213012 | A1* | 9/2008 | Ahn | 399/322 |
| 2011/0262166 | A1* | 10/2011 | Imamiya | |

FOREIGN PATENT DOCUMENTS

| | | |
|---|---|---|
| JP | 2004-331384 | 11/2004 |
| JP | 2006-133329 | 5/2006 |
| JP | 2009-288711 | 12/2009 |

* cited by examiner

*Primary Examiner* — David Gray
*Assistant Examiner* — Laura Roth
(74) *Attorney, Agent, or Firm* — Staas & Halsey LLP

(57) ABSTRACT

A fusing device and an image forming apparatus including the fusing device are provided, the fusing device having a structure that ensures a stable transport of a printing medium by preventing a printing medium from deviating from a transport path between a transfer nip and a fusing nip. The fusing device includes a heating member, a pressing member to contact the heating member to form a fusing nip, and a guide member to guide a printing medium to the fusing nip. An end of the guide member is shaped such that a height of the end decreases as the end extends from a center thereof to opposite sides thereof, and disposed closer to the heating member than to the pressing member, with respect to an imaginary line extending from the fusing nip.

11 Claims, 13 Drawing Sheets

FUSING DEVICE INCLUDING A GUIDE MEMBER TO GUIDE A PRINTING MEDIUM AND IMAGE FORMING APPARATUS HAVING THE SAME

CROSS-REFERENCE TO RELATED APPLICATIONS

This application is related to, and claims priority to, Korean Patent Application No. 10-2012-0016268, filed on Feb. 15, 2013 in the Korean Intellectual Property Office, the disclosure of which is incorporated herein by reference.

BACKGROUND

1. Field

Embodiments of the present invention are related to a fusing device to fix an image to a printing medium and an image forming apparatus having the same.

2. Description of the Related Art

An image forming apparatus forms an image on a printing medium. Examples of such an image forming apparatus include a printer, a copier, a facsimile machine, and a multifunction device combining functions of the disclosed apparatuses.

In an image forming apparatus using electrophotography, an electrostatic latent image may be formed on a surface of a photosensitive body charged with a predetermined electric potential by emitting light onto the photosensitive body. Toner is supplied onto the electrostatic latent image to form a visible image. The visible image formed on the photosensitive body may be directly transferred to a printing medium or transferred to the printing medium via an intermediate transfer body. The visible image transferred to the printing medium may be fixed to the printing medium while passing through the fusing device. The transfer roller contacts the photosensitive body to form a transfer nip to transfer the toner image formed on the photosensitive body to the printing medium, and a pressing member contacts a heating member of the fusing device to form a fusing nip to fix the visible image transferred to the printing medium.

If the printing medium fails to be smoothly transported between the transfer nip and the fusing nip and a part of the printing medium deviates from the transport path between the transfer nip and the fusing nip, the visible image transferred to the printing medium may have a defect that results in degradation of printing quality.

SUMMARY

An aspect of an exemplary embodiment of the present invention is to provide a fusing device having an improved structure that may ensure stable transport of a printing medium by preventing a printing medium from deviating from a transport path between a transfer nip and a fusing nip and an image forming apparatus having the same.

Additional aspects of the invention are set forth in part in the description that follows and, in part, will be obvious from the description, or may be learned from practice of the invention.

In accordance with an aspect of the present invention, a fusing device includes a heating member, a pressing member to contact the heating member to form a fusing nip, and a guide member to guide a printing medium to the fusing nip, wherein an end of the guide member is shaped such that a height of the end decreases as the end extends from a center thereof to opposite sides thereof, and disposed closer to the heating member than to the pressing member, with respect to an imaginary line extending from the fusing nip.

The end of the guide member may be formed in an arc shape.

The end of the guide member may be formed in a chamfer shape.

A difference in height between a center of an end of the guide member and the opposite sides of the end of the guide member may be between about 2.5 mm and about 3.5 mm.

A closest distance between an imaginary line extending from the fusing nip and the end of the guide member may be between about 1.2 mm and about 1.5 mm.

A closest distance between a heating member and the end of the guide member may be between about 0.5 mm and about 1.5 mm.

In accordance with an aspect of the present invention, an image forming apparatus includes a photosensitive body, a transfer roller to contact the photosensitive body to form a transfer nip to transfer a toner image on the photosensitive body to a printing medium, and a fusing device to fix the transferred toner image to the printing medium, wherein the fusing device includes a heating roller rotatably arranged, a pressing roller to contact the heating roller to form a fusing nip, and a guide member to guide the printing medium to the fusing nip after the printing medium passes the transfer nip, wherein an end of the guide member is disposed closer to the heating member than to the pressing member, with respect to an imaginary line extending from the fusing nip, wherein a distance from the end of the guide member to an outer circumferential surface of the heating roller increases as the end of the guide member extends from a center thereof to opposite sides thereof.

An angle formed between a first imaginary line extending from the transfer nip and a second imaginary line extending from the fusing nip may be greater than 90° and less than 180°.

The guide member may be disposed under the heating roller and the pressing roller.

The fusing device may include a housing to accommodate the heating roller and the pressing roller, wherein the guide member may include a coupling part coupled to the housing, and a guide part slantingly connected to the coupling part and forming at least one portion of a transport path of the printing medium between the transfer nip and the fusing nip.

The image forming apparatus may include at least one guide rib disposed between the transfer nip and the guide member to form the transport path of the printing medium together with the guide part.

The pressing roller may have a shape of an inverted crown.

A difference in height between the center of the end of the guide member and the opposite sides of the end of the guide member may be between about 2.5 mm and about 3.5 mm.

The end of the guide member may be formed in an arc shape.

A closest distance between the imaginary line extending from the fusing nip and the end of the guide member may be between about 1.2 mm and about 1.5 mm.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
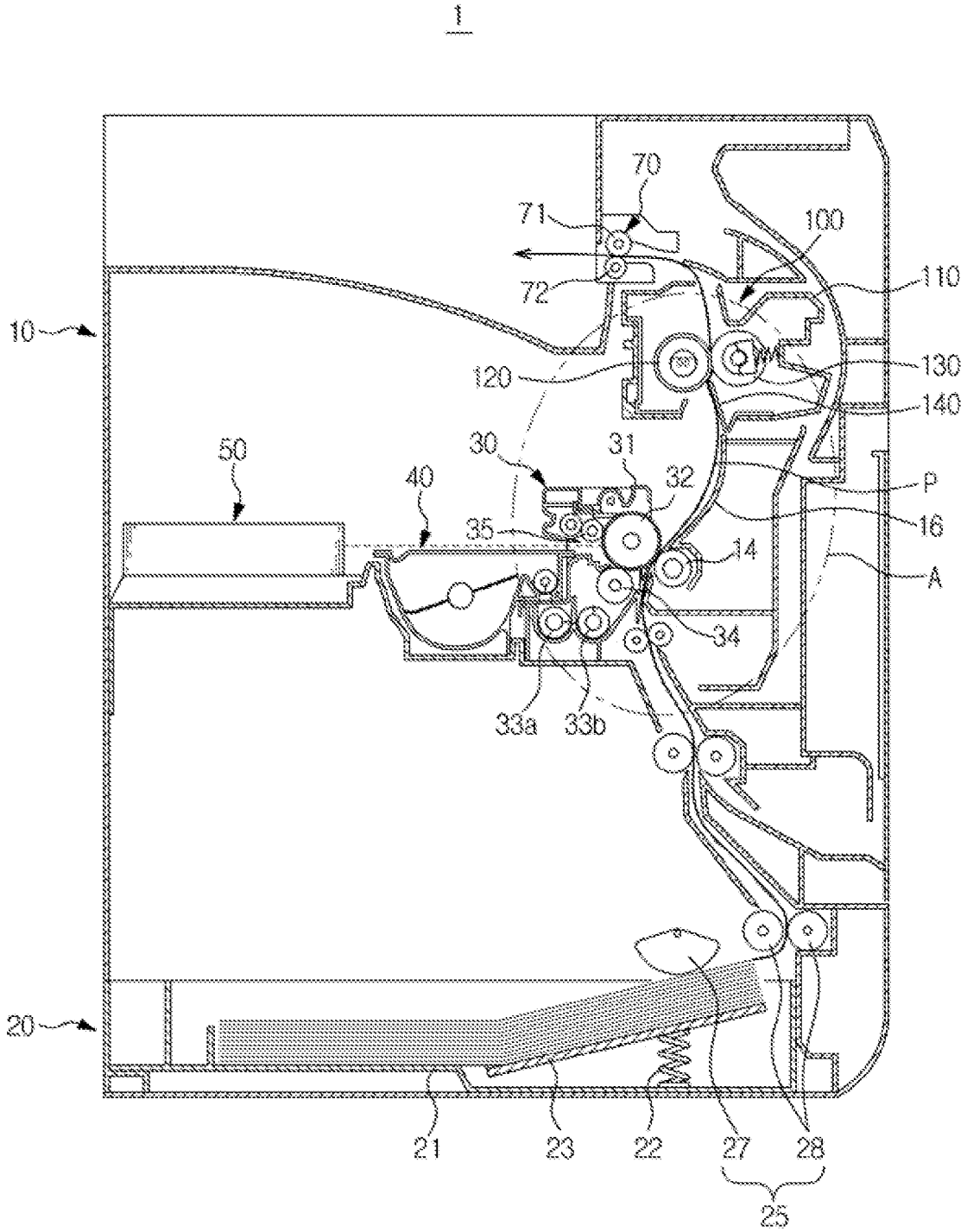
FIG. 1 illustrates an image forming apparatus according to an exemplary embodiment of the present invention.

Reference will now be made in detail to the embodiments of the present invention, examples of which are illustrated in the accompanying drawings, wherein like reference numerals refer to like elements throughout. FIG. 1 illustrates an image forming apparatus according to an exemplary embodiment of the present invention, and FIG. 2 is an enlarged view of portion "A" illustrated in FIG. 1.

Figure 2:
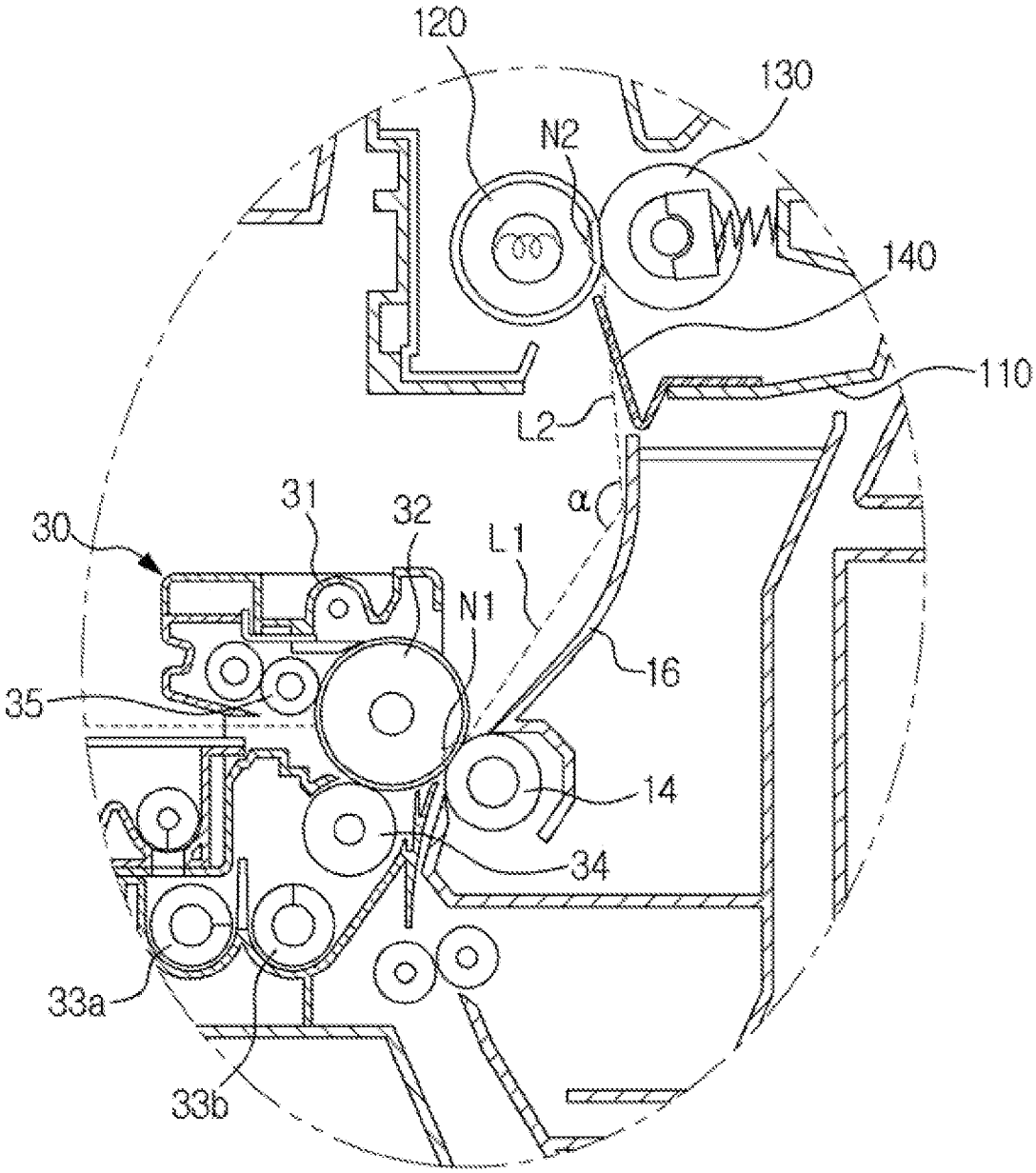
FIG. 2 is an enlarged view of portion "A" illustrated in FIG. 1.

As illustrated in FIGS. 1 and 2, the image forming apparatus 1 includes a body 10, a feeding device 20 to store and feed a printing medium S, a developing device 30 to form a image on the printing medium S fed through the feeding device 20, a toner device 40 to feed toner to the developing device 30, an optical scanning device 50 to form an electrostatic latent image on a photosensitive body 32 of the developing device 30, a fusing device 100 to fix a transferred toner image to the printing medium S, and a discharge device 70 to discharge the printing medium S having the image formed thereon to the outside of the body 10.

The feeding device 20, which stores and feeds a printing medium S, may be arranged at a lower portion of the body 10 to feed the printing medium S toward the developing device 30.

The feeding device 20 may include a cassette-type feed tray 21 retractably placed in the body 10 to store the printing medium S, and a transport member 25 to pick up the printing media S stored in the feed tray 21 one by one and transport the same toward the developing device 30.

A knock-up plate 23 may be provided in the feed tray 21. One end of the knock-up plate 23 may be rotatably coupled, and the other end thereof may be supported by a compression spring 22 to transport the stacked printing media S toward the transport member 25.

The transport member 25 may include a pick-up roller 27 to pick up the printing medium S stacked on the knock-up plate 23 one by one, and a feed roller pick-up roller 28 to transport the printing medium S picked up by the pick-up roller 27 toward the developing device 30.

The developing device 30 includes a housing 31 forming an external appearance thereof, a photosensitive body 32 rotatably coupled to the inside of the housing 31 to form an electrostatic latent image, churning screws 33*a* and 33*b* to churn the toner fed from the toner device 40, a developing roller 34 to feed the toner churned by the churning screws 33*a* and 33*b* to the photosensitive body 32, and a charging member 35 to charge the photosensitive body 32.

The toner from the toner device 40 may be introduced into the housing 31, churned by the churning screws 33*a* and 33*b* and transported to one side of the housing 31. The churned and transported toner may be fed to the photosensitive body 32 by the developing roller 34 to form a visible image.

To transfer the visible image formed on the photosensitive body 32 by the toner to the printing medium S, the photosensitive body 32 contacts the transfer roller 14 and forms a transfer nip N1. The transfer roller 14 may be rotatably disposed in the body 10.

The toner device 40 may be coupled to the developing device 30 and adapted to accommodate and retain the toner to form an image on a printing media S and to feed the toner to the developing device 30 as image formation proceeds.

The optical scanning device 50 emits light including information about an image onto the photosensitive body 32 to form an electrostatic latent image on the photosensitive body 32.

The fusing device 100 applies heat and pressure to the printing medium S to fix the toner image formed on the printing medium S to the printing medium S.

The discharge device 70 includes a first paper discharge roller 71 and a second paper discharge roller 72, which may be sequentially installed, and discharge the printing medium S leaving the fusing device 100 to the outside of the body 10.

Disposed between the transfer nip N1 and fusing device 100 may be a guide rib 16 to guide the printing medium S leaving the transfer nip N1 to the fusing device 100. The guide rib 16 forms a portion of the transport path P of the printing medium S between the transfer nip N1 and the fusing device 100.

Figure 3:
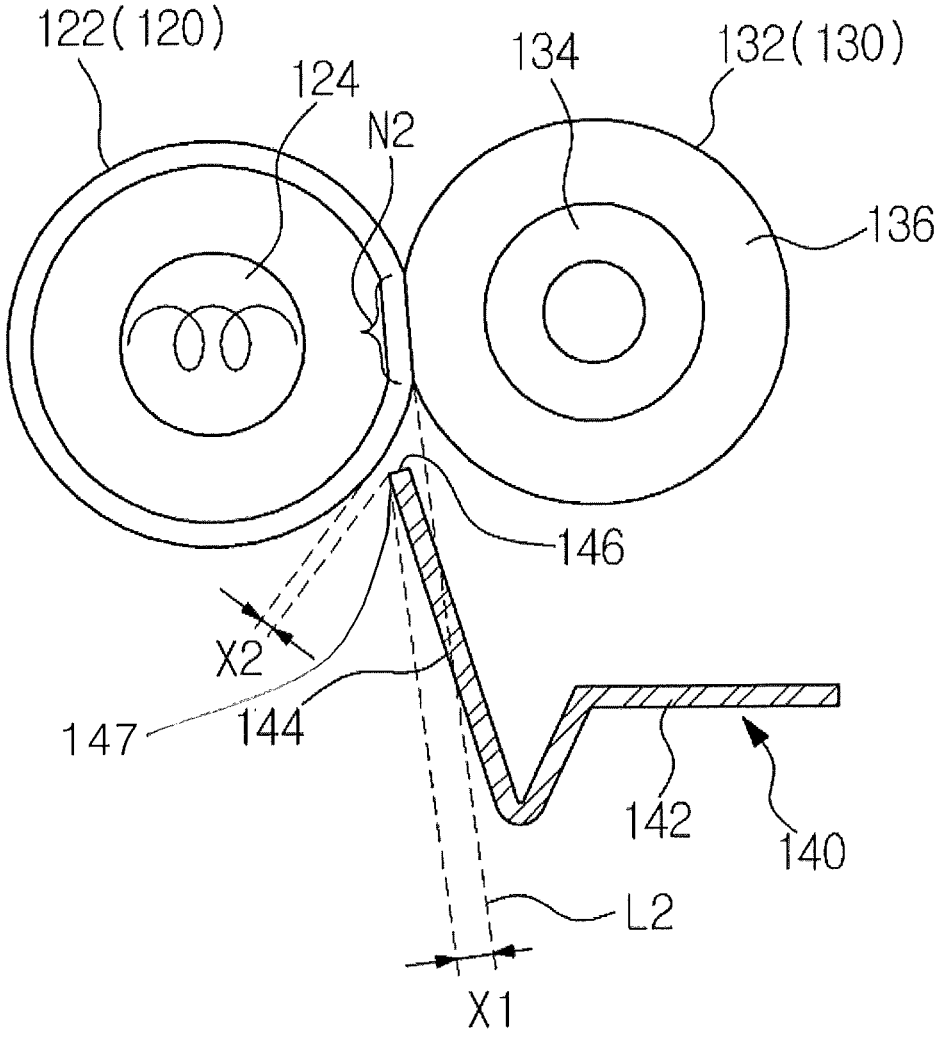
FIG. 3 illustrates a fusing device according to an embodiment of the present invention.
Figure 4:
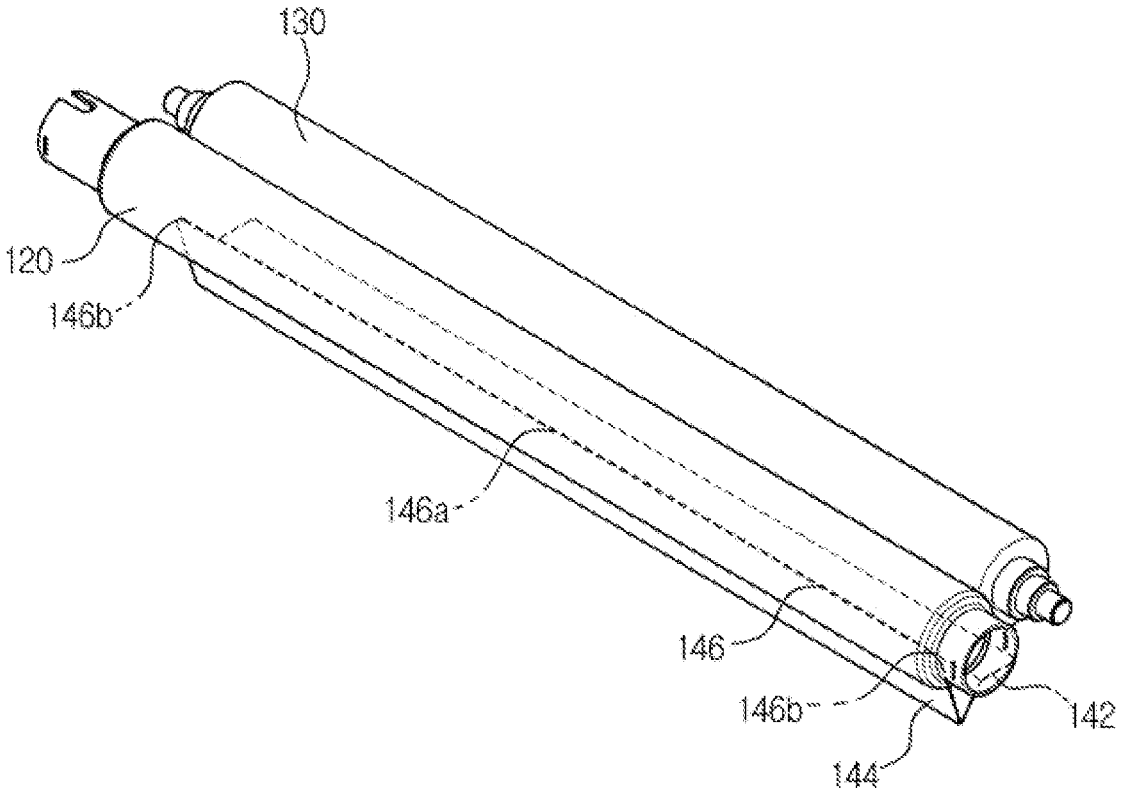
FIG. 4 illustrates an exemplary heating member and an exemplary pressing member.
Figure 5:
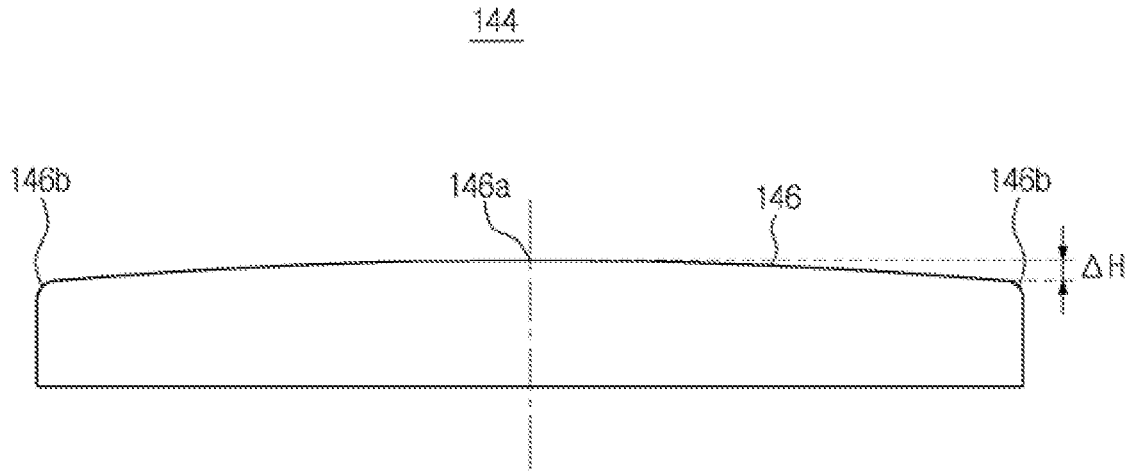
FIG. 5 illustrates an exemplary guide portion of a guide member.
Figure 6:
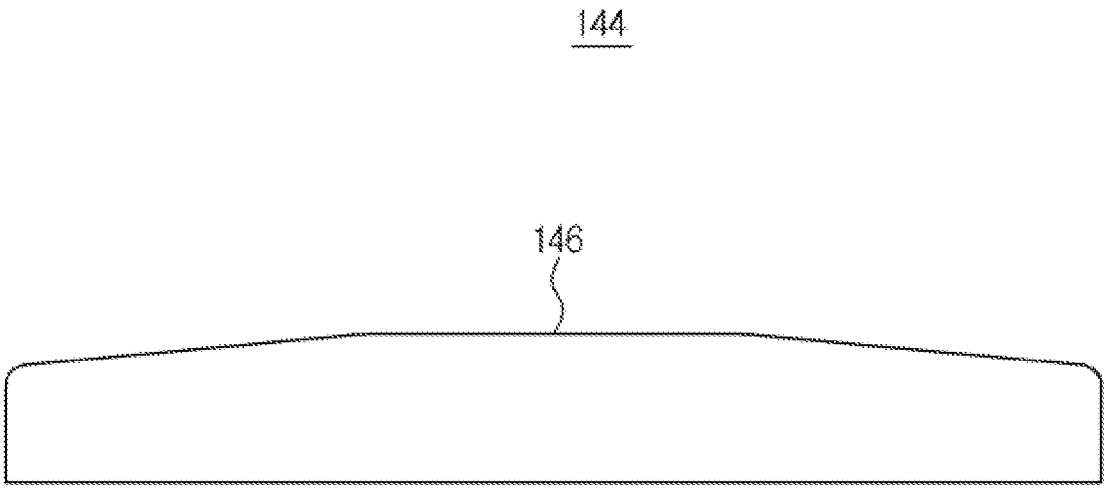
FIG. 6 illustrates an exemplary guide portion.
Figure 7A:
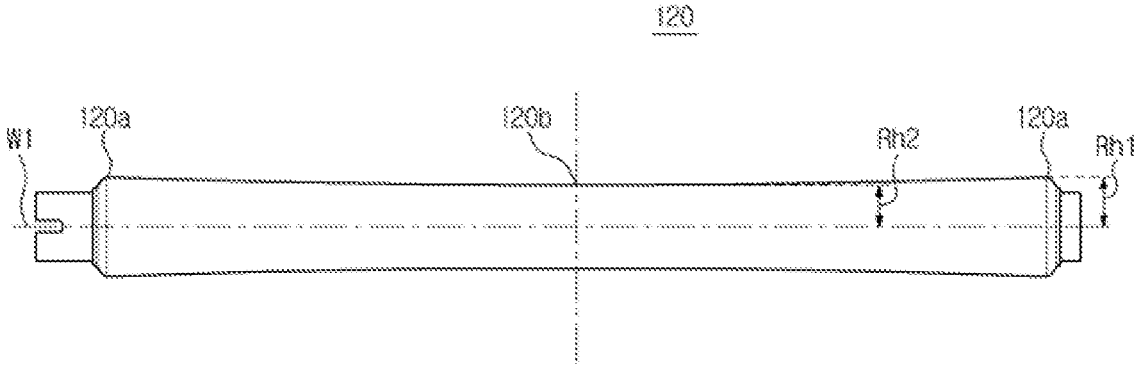
FIGS. 7A and 7B illustrate an exemplary heating member and an exemplary pressing member, respectively.
Figure 7B:
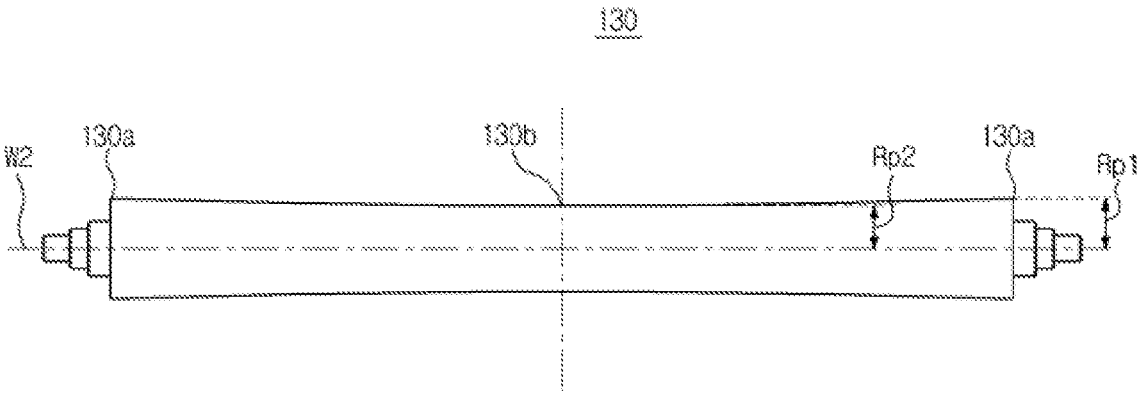
Figure 8:
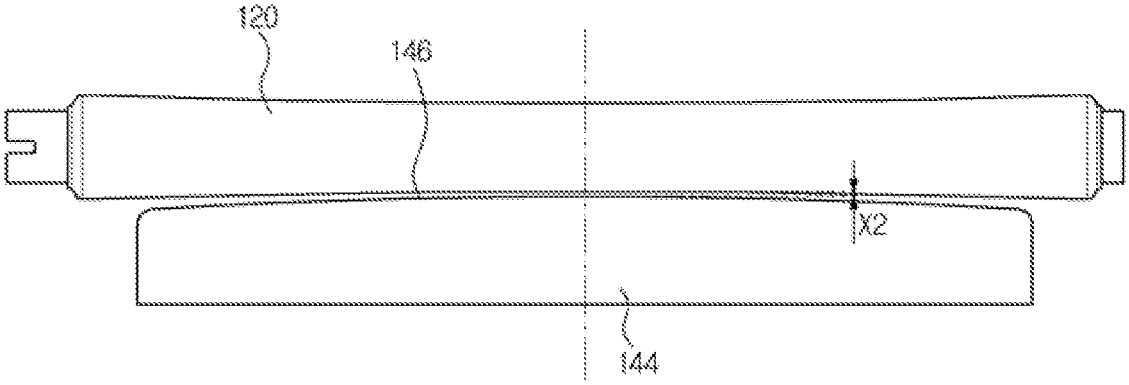
FIG. 8 illustrates an exemplary positional relationship between the heating member and the guide member.

FIG. 3 illustrates a fusing device according to an embodiment of the present invention, FIG. 4 illustrates an exemplary heating member and an exemplary pressing member, FIG. 5 illustrates an exemplary guide portion of the guide member. FIG. 6 illustrates an exemplary guide portion, FIGS. 7A and 7B illustrate an exemplary heating member and an exemplary pressing member, respectively, and FIG. 8 illustrates an exemplary positional relationship between the heating member and the guide member.

As illustrated in FIGS. 2 to 8, the fusing device 100 includes a housing 110, a heating member 120 and a pressing member 130, the heating member 120 and pressing member 130 being rotatably disposed in the housing.

The printing medium S having a toner image transferred thereto may be passed between the heating member 120 and the pressing member 130. The toner image may be fixed to the printing medium S by heat and pressure.

The heating member 120 may be adapted to rotate, engaging with the pressing member 130. The heating member 120 forms a fusing nip N2 together with the pressing member 130, and transfers heat to the printing medium S when the printing medium S heated by a heat source 124 passes between the fusing nip N2. The heating member 120 may include a heating roller 122 adapted to rotate by power transmitted from a drive source (not shown).

The heating member 120 may be provided with the heat source 124 to apply heat to the printing medium S having the toner transferred thereto. To improve fusing performance, at least two heat sources 124 may be disposed. As the heat source 124, a halogen lamp, a heating wire, an induction heater, or the like may be used.

The pressing member 130 may be disposed to contact an outer circumferential surface of the heating member 120 to have a fusing nip N2 formed between the pressing member 130 and the heating member 120. The pressing member 130 may include a pressing roller 132 adapted to rotate with a power transmitted from a drive source (not shown).

The pressing roller 132 may be provided with a shaft 134 formed of a metal material such as aluminum or steel, and an elastic layer 136 elastically deformable to form the fusing nip N2 between the pressing roller 132 and the heating member 120. The elastic layer may be formed of silicone rubber. To allow high fusing pressure to be applied to the printing medium S by the fusing nip N2, the elastic layer 136 may have a hardness between about 50 and about 80 on the ASKER-C scale, and thickness between about 3 mm and about 6 mm. The surface of the elastic layer 136 may be provided with a release layer to prevent the printing medium sticking to the pressing roller 132.

To prevent the printing medium S from being deformed by heat and pressure applied thereto while passing through the fusing nip N2, the heating member 120 and the pressing member 130 may be formed to have an inverted crown shape. That is, the heating member 120 may be formed such that the distance Rh1 of the opposite ends 120*a* of the heating member 120 from the center of rotation W1 of the heating member 120 is greater than the distance Rh2 between the center of rotation W1 and the center 120*b* of the heating member 120, and the pressing member 130 is formed such that the distance Rp1 of the opposite ends 130*a* of the pressing member 130 from the center of rotation W2 of the pressing member 130 is greater than the distance Rp2 between the center of rotation W2 and the center 130*b* of the pressing member 130.

To allow the printing medium S to be smoothly transported along the path between the transfer nip N1 and the fusing nip N2, the transfer nip N1 and the fusing nip N2 may be arranged such that the angle formed therebetween is greater than 90° and less than 180°. That is, the angle a between a first imaginary line L1 extending from the transfer nip N1 and a second imaginary line L2 extending from the fusing nip N2 is greater than 90° and less than 180°.

A guide member 140 may be disposed under the heating member 120 and the pressing member 130 to guide the printing medium S passing transfer nip N1 to the fusing nip N2.

The guide member 140 includes a coupling part 142 that may be coupled to the housing 110, and a guide part 144 that may be slantingly connected to the coupling part 142 and forming a transport path P of the printing medium S between the transfer nip N1 and the fusing nip N2, together with the guide ribs 16.

The guide part 144 may be shaped such that the height of the end 146 decreases as it extends from the center 146*a* to opposite sides 146*b*. The shape includes an arc or a chamfer as illustrated in FIGS. 5 and 6. When the printing medium S pass the end 146 of the guide part 144, both lateral ends of the printing medium S may be bent toward the guide part 144 (see, for example, FIG. 9), and the printing medium S enters the fusing nip N2 with both lateral ends thereof bent. A difference in height ΔH between the center 146*a* of the end 146 of the guide part 144 and both sides 146*b* of the end 146 of the guide part 144 may be between about 2.5 mm and about 3.5 mm.

If the difference in height ΔH is less than 2.5 mm, an extent to which both lateral ends of the printing medium S are bent toward the guide part 144 is low, and thus the behavior stability of the printing medium S is lowered. When impact is applied to the printing medium S, causing the rear end of the printing medium S to deviate from the transfer nip N1, part of the printing medium S including the rear end thereof may deviate from the transport path P between the transfer nip N1 and the fusing nip N2 and hit other components therearound, resulting in image defects.

If the difference in height ΔH is greater than 3.5 mm, the extent to which both lateral ends of the printing medium S may be bent toward the guide part 144 becomes too high, and thus the end 146 of the guide part 144 may resist transport of the printing medium S, resulting in abnormal transport of the printing medium S.

The end 146 of the guide part 144 may be disposed closer to the heating member 120 than to the pressing member 130, with respect to the second imaginary line L2 extending from the fusing nip N2. The shortest distance X1 between the second line L2 extending from the fusing nip N2 and the end 146 of the guide part 144 may be between about 1.2 mm and about 1.5 mm.

If the shortest distance X1 is less than 1.2 mm, an extent to which the portion of the printing medium S near the end 146 of the guide part 144 is bent in a direction K2 different from the direction K1 in which the printing medium S is transported from the transfer nip N1 becomes low (see, for example, FIGS. 9, 11 and 12), and thereby both lateral ends of the printing medium S may not be bent toward the guide part 144 or may be insufficiently bent, resulting in lower stability of the printing medium S. When impact is applied to the printing medium S, causing the rear end of the printing medium S to deviate from the transfer nip N1, part of the printing medium S including the rear end thereof may deviate from the transport path P between the transfer nip N1 and the fusing nip N2 and hit other components therearound, causing image defects.

If the shortest distance X1 is greater than 1.5 mm, the extent to which the portion of the printing medium S near the end 146 of the guide part 144 is bent in a direction different from the direction in which the printing medium S is transported from the transfer nip N1 becomes excessively high, and thereby the end 146 of the guide part 144 may resist transport of the printing medium S, preventing smooth transport of the printing medium S. In addition, when impact is applied to the printing medium S, causing the rear end of the printing medium S to deviate from the transfer nip N1, part of the printing medium S including the rear end thereof deviates from the transport path P between the transfer nip N1 and the fusing nip N2, and hits other components therearound, causing image defects.

A shortest distance X2 between an edge 147 of the end 146 of the guide part 146,which faces the heating member 120, and the heating member 120 may be between about 0.5 mm and about 1.5 mm.

If the shortest distance X2 is less than 0.5 mm, the end 146 of the guide part 144 may contact the outer circumferential surface of the heating member 120, or the printing medium S may not be smoothly transported between the end 146 of the guide part 144 and the heating member 120.

If the shortest distance X2 is greater than 1.5 mm, the extent to which the printing medium S is bent near the end 146 of the guide part 144 in a direction different from the direction in which the printing medium S is transported from the transfer nip N1 becomes low, and thereby both lateral ends of the printing medium S may not be bent toward the guide part 144 or may be insufficiently bent, resulting in lower behavior stability of the printing medium S. When impact is applied to the printing medium S, causing the rear end of the printing medium S to deviate from the transfer nip N1, part of the printing medium S including the rear end thereof may deviate from the transport path P between the transfer nip N1 and the fusing nip N2 and hit other components therearound, causing image defects.

A detailed description is given of how the printing medium S is stably transported along the transport path P according to the shape of the end 146 of the guide part 144 and the positional relationship between the end 146 of the guide part 144 and the heating member 120 as described above when the printing medium S is passed between the transfer nip N1 and the fusing nip N2.

Figure 9:
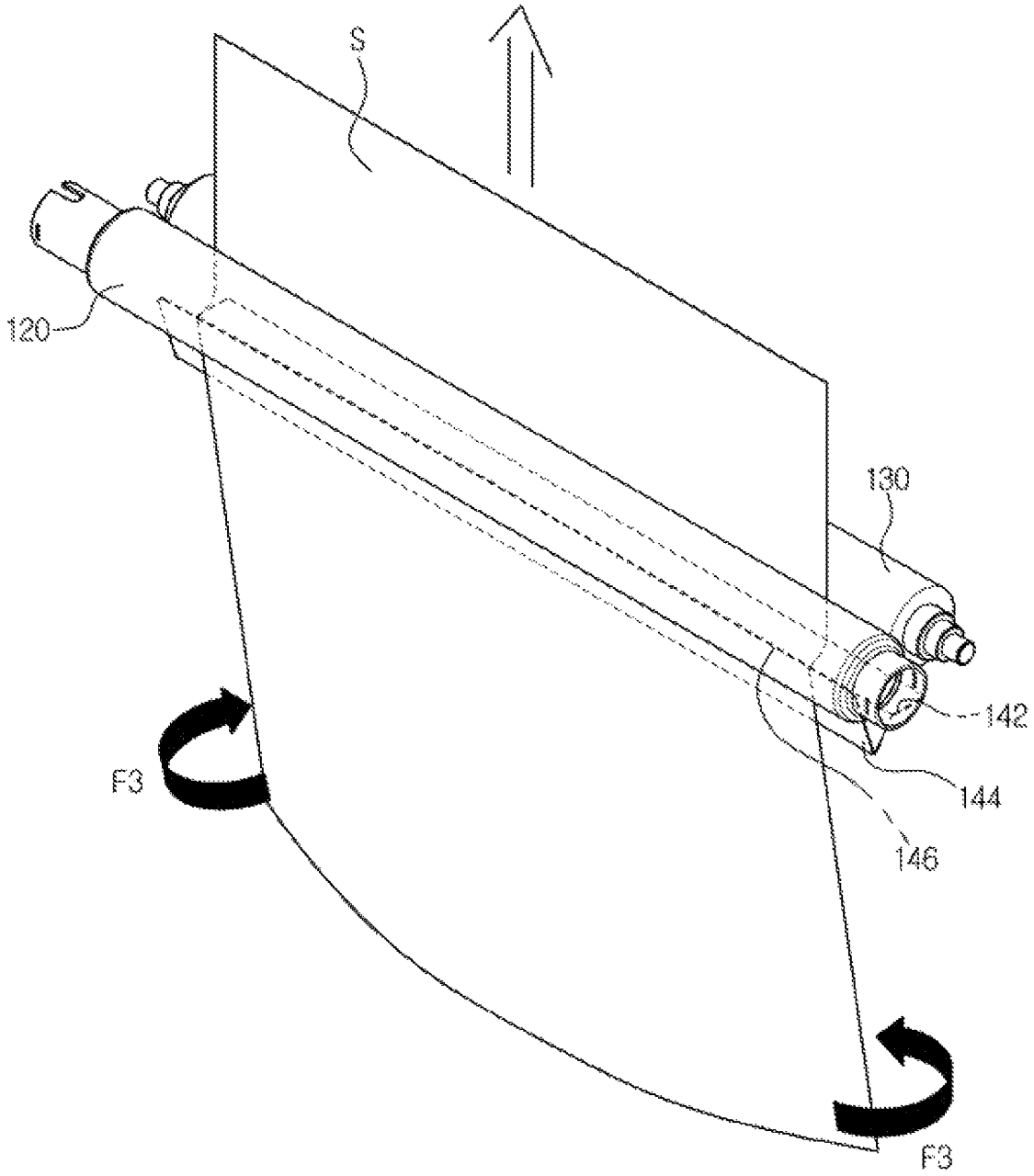
FIG. 9 illustrates an exemplary force exerted on the printing medium by the shape of the end of the guide portion.
Figure 10:
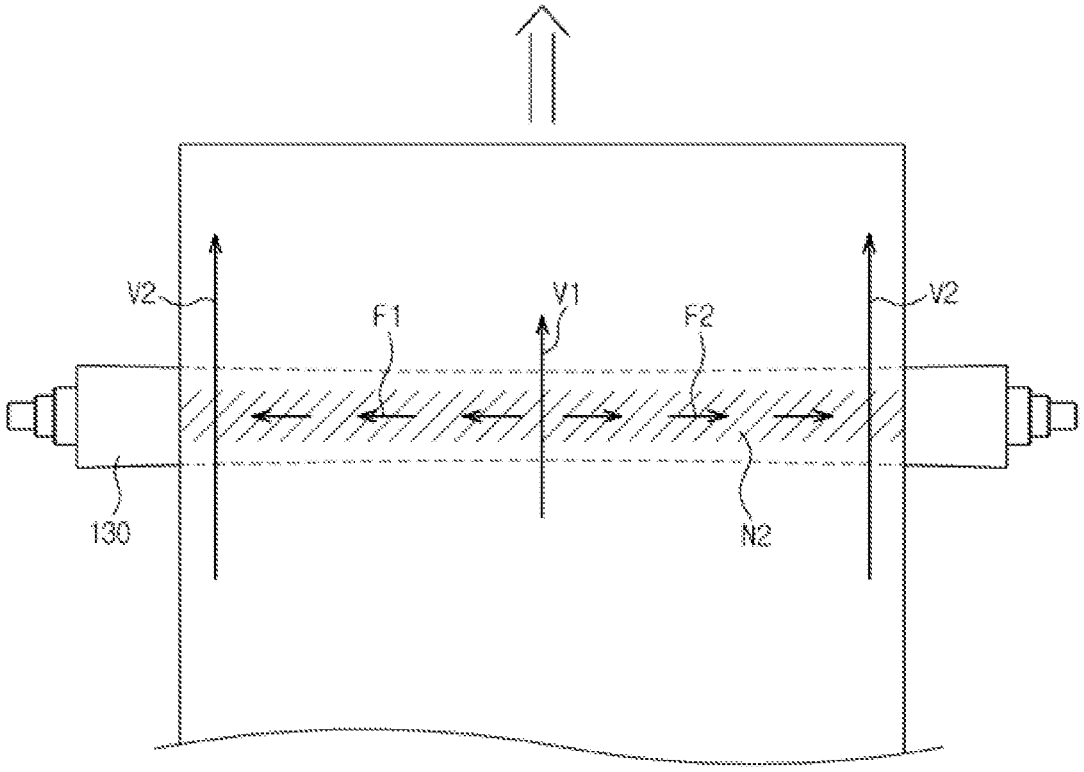
FIG. 10 illustrates an exemplary force exerted on the printing medium at the fusing nip.
Figure 11:
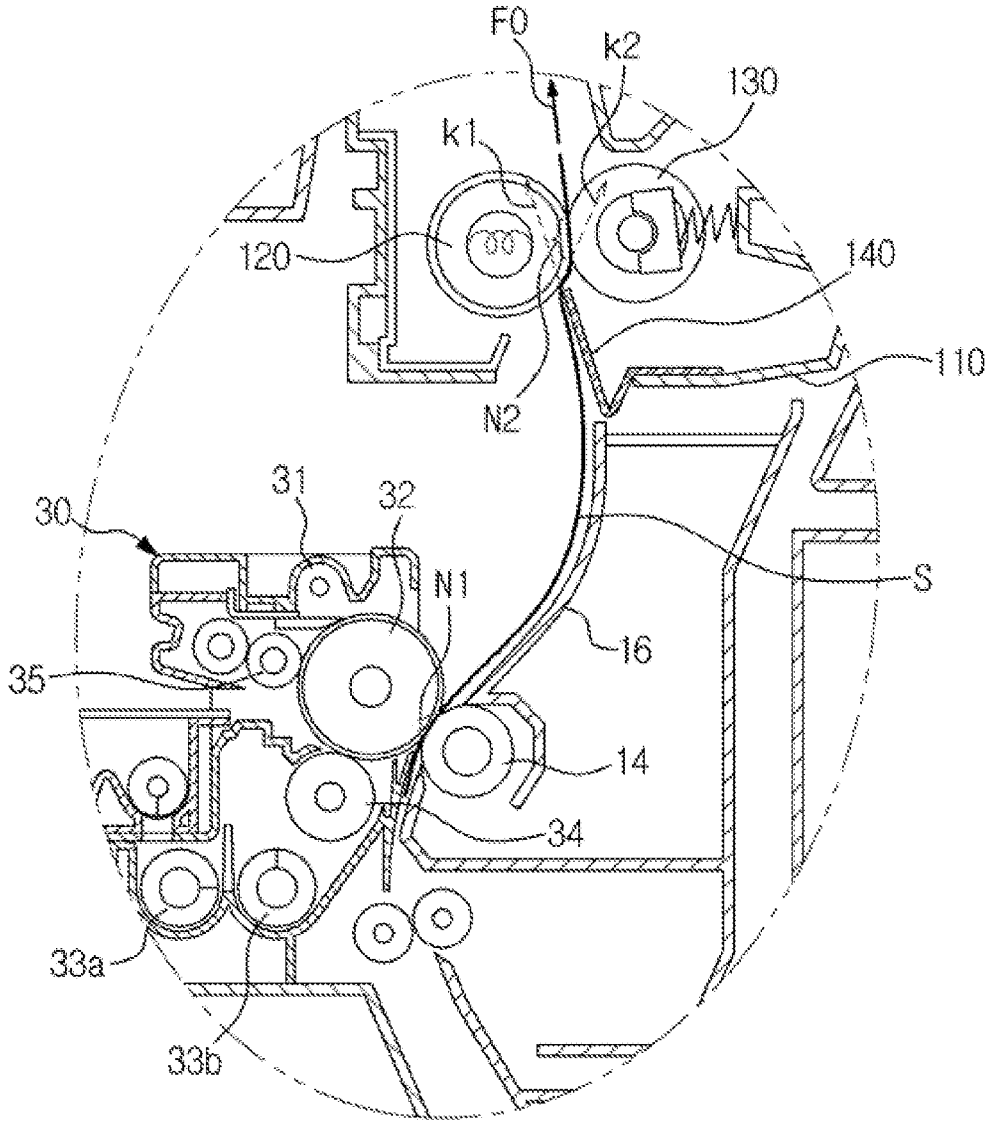
FIG. 11 illustrates an exemplary process of transporting a printing medium between a transfer nip and a fusing nip, in which a leading edge and a trailing edge of the printing medium are respectively engaged in the fusing nip and the transfer nip.
Figure 12:
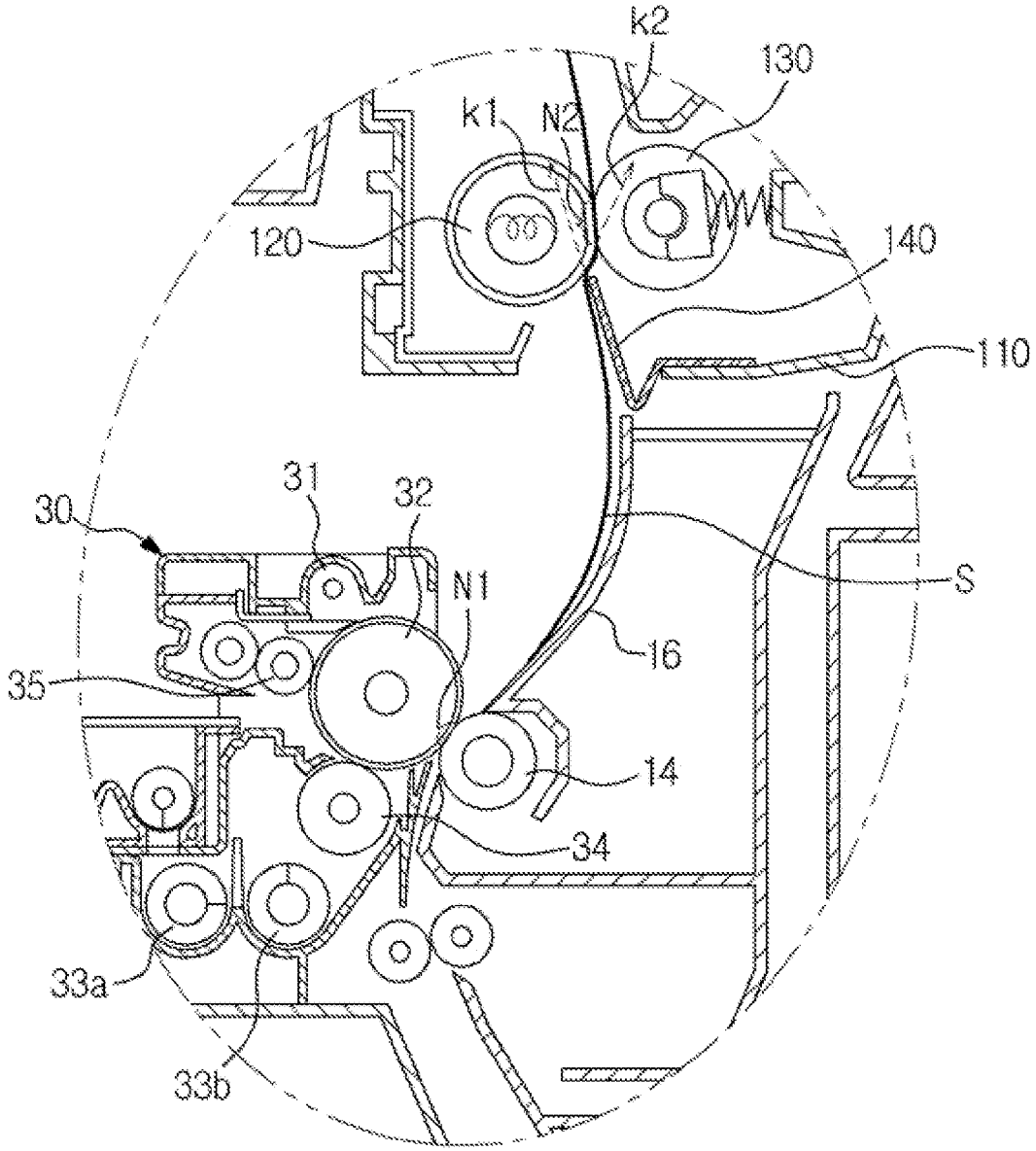
FIG. 12 illustrates an exemplary process of transporting the printing medium between a transfer nip and a fusing nip, in which a trailing edge of the printing medium has left the transfer nip.

FIG. 9 illustrates an exemplary force exerted on the printing medium by the shape of the end of the guide portion, and FIG. 10 illustrates an exemplary force exerted on the printing medium at the fusing nip. FIG. 11 illustrates an exemplary process of transporting the printing medium between the transfer nip and the fusing nip, in which the leading edge and the trailing edge of the printing medium are respectively engaged with the fusing nip and the transfer nip, and FIG. 12 illustrates an exemplary process of transporting the printing medium between the transfer nip and the fusing nip, in which the trailing edge of the printing medium has left the transfer nip.

As illustrated in FIG. 11, once the leading edge of the printing medium S is engaged with the fusing nip N2, a force F0 draws the printing medium S in a direction parallel to the fusing nip N2 according to rotation of the heating member 120 and the pressing member 130.

The heating member 120 and the pressing member 130 may have a shape of an inverted crown, and thus when the printing medium S passes the fusing nip N2, the speed V2 of both lateral ends of the printing medium S is greater than the speed V1 of the center of the printing medium S. By the difference in speed between the center and the lateral ends of the printing medium S, forces F1 and F2 pulling the printing medium S in approximately opposite directions are applied to the printing medium S when the printing medium S passes the fusing nip N2, as illustrated in FIG. 10.

Since the end 146 of the guide part 144 is disposed closer to the heating member 120 than to the pressing member 130, with respect to the second imaginary line L2 extending from the fusing nip N2, the portion of the printing medium S near the end 146 of the guide part 144 is bent, by the force FO acting on the printing medium S, in a direction K2 different from the direction K1 in which the printing medium S is transported from the transfer nip N1. A force F3 to bend both lateral ends of the printing medium S is produced by the forces F0, F1 and F2 acting on the printing medium S and the shape of the end 146 of the guide part 144, and therefore the lateral ends of the printing medium S are bent toward the guide part 144, as illustrated in FIG. 9.

As such, when the printing medium S is transported between the transfer nip N1 and the fusing nip N2, the lateral ends of the printing medium S are bent toward the guide part 144, and thereby even when impact that may cause the rear end of the printing medium S to deviate from the transfer nip N1 is applied to the printing medium S, the printing medium S may be prevented from deviating from the transport path P between the transfer nip N1 and the fusing nip N2 and may thus be stably transported.

Thus, according to an exemplary embodiment of the present invention, a printing medium may be stably transported along a transport path between a transfer nip and a fusing nip by properly shaping and positioning a guide member to guide the printing medium to the fusing nip.

In addition, a high-quality image may be obtained.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A fusing device comprising:

a heating member;

a pressing member to contact the heating member to form a fusing nip; and a guide member including a guiding part to guide a printing medium to the fusing nip, wherein an end of the guiding part of the guide member is shaped such that a height of the guiding part decreases as an end of the guiding part extends from a center thereof to opposite sides thereof, and the end of the guiding part faces the heating member and is disposed closer to the heating member than to the pressing member, with respect to an imaginary line extending from a center of the fusing nip in a direction parallel to a surface of the heating member contacting a surface of the pressing member to form the fusing nip, the guiding part forming at least one portion of a transport path of the printing medium in a substantially vertical direction, wherein a closest distance between the heating member and an edge of the end of the guiding part, which faces the heating member, that is farthest from the pressing member is between about 0.5 mm and about 1.5 mm, and wherein a difference in height between the center of the end of the guiding part and the opposite sides of the end of the guiding part is between about 2.5 mm and about 3.5 mm.

2. The fusing device according to claim 1, wherein the end of the guide member is formed in an arc shape.

3. The fusing device according to claim 1, wherein the end of the guide member is formed in a chamfer shape.

4. The fusing device according to claim 1, wherein a closest distance between the imaginary line extending in the parallel direction from the fusing nip and the end of the guide member is between about 1.2 mm and about 1.5 mm.

5. An image forming apparatus comprising:

a photosensitive body;

a transfer roller to contact the photosensitive body to form a transfer nip to transfer a toner image on the photosensitive body to a printing medium; and a fusing device to fix the transferred toner image to the printing medium, wherein the fusing device comprises:

a heating roller rotatably arranged, a pressing roller to contact the heating roller to form a fusing nip, and a guide member including a guiding part to guide the printing medium to the fusing nip after the printing medium passes the transfer nip, the guiding part forming at least one portion of a transport path of the printing medium in a substantially vertical direction, wherein an end of the guiding part of the guide member faces the heating member and is disposed closer to the heating member than to the pressing member, with respect to an imaginary line extending from a center of the fusing nip in a direction parallel to a surface of the heating roller contacting a surface of the pressing roller to form the fusing nip, wherein a distance from the end of the guiding part of the guide member to an outer circumferential surface of the heating roller increases as the end of the guiding part of the guide member extends from a center thereof to opposite sides thereof, wherein a closest distance between the imaginary line extending from the center of the fusing nip and an edge of the end of the guiding part of the guide member, which faces the heating member, that is farthest from the pressing roller is between about 1.2 mm and about 1.5 mm, and wherein a difference in height between the center of the end of the guide part and the opposite sides of the end of the guide part is between about 2.5 mm and about 3.5 mm.

6. The image forming apparatus according to claim 5, wherein an angle formed between a first imaginary line extending from the transfer nip and a second imaginary line extending from the fusing nip is greater than 90° and less than 180°.

7. The image forming apparatus according to claim 5, wherein the guide member is disposed under the heating roller and the pressing roller.

8. The image forming apparatus according to claim 5, wherein the fusing device comprises a housing to accommodate the heating roller and the pressing roller, wherein the guide member comprises:

a coupling part coupled to the housing, and the guiding part slantingly connected to the coupling part and forming at least one portion of a transport path of the printing medium between the transfer nip and the fusing nip.

9. The image forming apparatus according to claim 8, further comprising at least one guide rib disposed between the transfer nip and the guide member to form the transport path of the printing medium together with the guiding part.

10. The image forming apparatus according to claim 5, wherein the pressing roller has a shape of an inverted crown.

11. The image forming apparatus according to claim 5, wherein the end of the guide member is formed in an arc shape.

* * * * *